US005598650A

United States Patent [19]

Brown

[11] Patent Number: 5,598,650

[45] Date of Patent: Feb. 4, 1997

[54] MULTI-ITEM DISPLAY UNIT

[76] Inventor: Brigitte L. Brown, 33 Dryden Rd., New Castle, Del. 19720

[21] Appl. No.: 312,540

[22] Filed: Sep. 26, 1994

[51] Int. Cl.[6] ..... G09F 19/14

[52] U.S. Cl. ..... 40/453; 40/594

[58] Field of Search ..... 40/453, 594, 160

[56] References Cited

U.S. PATENT DOCUMENTS

| | | | |
|---|---|---|---|
| 4,090,464 | 5/1978 | Bishopp et al. | 40/594 X |
| 4,233,767 | 11/1980 | Hryhorczuk | 40/453 |
| 4,255,380 | 3/1981 | Björkland | 40/453 X |
| 4,356,650 | 11/1982 | Antonczyk et al. | 40/160 |
| 4,422,253 | 12/1983 | Babber | 40/453 |
| 4,937,960 | 7/1990 | Otake | 40/453 |

*Primary Examiner*—Joanne Silbermann
*Attorney, Agent, or Firm*—Connolly & Hutz

[57] ABSTRACT

A multi-item display unit includes two separate pictures or display items, such as photographs, each of which is segmented into elongated strips. The elongated strips are mounted to a flexible support film in an alternating fashion so that the strips forming one item are mounted in the same sequence that the strips would be in before the item is segmented. A sequential strip from the second item is located between adjacent pairs of the elongated strips of the first item. The resulting laminate is mounted to a corrugated rigid support member with the laminate being bent along the contact lines of the elongated strips so that one item in its entirety would be solely viewed when viewed at an angle generally perpendicular to the elongated strips of that item and the other item would be viewed solely and in its entirety when the angle of view is generally at a right angle to the elongated strips of the second item.

19 Claims, 3 Drawing Sheets

MULTI-ITEM DISPLAY UNIT

BACKGROUND OF THE INVENTION

Various attempts have been made to provide a composite of two different pictures or display items which are cut into strips and arranged in an alternating manner so that when bent in an accordion type shape one of the pictures could be seen when viewed at one angle and the other picture could be seen when viewed at the other angle. Heretofore, however, these techniques have not been attempted with actual photographs which are mounted in such a manner that the composite could be displayed in the same manner as a conventional photograph. Even for other display items, prior techniques have been difficult to practice.

The prior attempts have generally involved complicated kits or other display devices. Exemplary of these approaches are U.S. Pat. Nos. 4,233,767; 4,422,253; 385,912; 386,780; 386,883; 401,165; 824,860; 922,015; 942,498; 135,363; 2,088,762; 4,255,380.

SUMMARY OF THE INVENTION

An object of this invention is to provide a multi-item display unit which can be easily assembled.

A further object of this invention is to provide a multi-item display unit wherein the items may be actual photographs and which is capable of having the individual photographs selectively viewed in accordance with the viewing angle.

A still further object of this invention is to provide a multiphotograph display unit which simulates a conventional photograph in that it can be framed and displayed in the same manner as a conventional photograph.

A yet further object of this invention is to display various pair of items of varying size ranging from only a few inches to billboard size.

In accordance with this invention, two display items, such as photographs, are segmented into elongated strips. Each item is then mounted to a flexible support film in the same sequence of the strips before the photograph was segmented. Sets of adjacent strips are spaced from each other so that the strips of one item could be alternated between strips of the other item. The lines of contact of adjacent strips function as fold lines for folding or bending the backing film to form an accordion type arrangement with V-shaped peaks and valleys when the resulting composite is mounted on a rigid corrugated support member. Each V-shape comprises a strip of each of the items. Each of the strips of the first item is parallel to the other strips and the strips of the second item are parallel to each other. The first item in its entirety would solely be viewed when the viewing angle is at about 90° to the first elongated strips. Similarly, the second item would be viewed in its entirety and solely viewed when the angle of view is at about 90° to the second elongated strips. The viewing image changes as the viewing angle changes. Thus, a person walking or otherwise moving past the display unit might view one item and then right before the person's eyes the viewing image would turn into the second item.

In one practice of the invention the laminate formed by the elongated strips and the support film is mounted to the support member with a frame being disposed around the laminate so as to result in a display unit similar in general appearance to the conventional display of photographs, except for the changing view in accordance with the angle of view.

The laminate may be secured to the support member by a double edge tape on the support member with the valleys of the laminate contacting the tape. The frame may be self standing in manners conventionally known for photograph frames.

In a preferred practice of the invention the display items are mounted face down directly on the support film. Thus, the film serves the dual function of providing a surface for holding the strips of items during the assembly of the display unit and also providing a protective cover for the items once the display unit has been assembled. In this practice the support film would be transparent.

The preferred practice of the invention also includes mounting the composite form from the film/strips/support member to a rigid base member which would then facilitate the final use of the unit including mounting the composite within a frame, such as in a display of photographs, or even mounting the composite to a billboard where, for example, the display unit could include advertising pictures or messages.

A BRIEF DESCRIPTION OF THE DRAWINGS

DETAILED DESCRIPTION

The present invention involves a multi-item display unit which is formed by initially taking two display items, such as photographs, which are each cut or segmented into uniform elongated strips of the same size and shape. The elongated strips of one item are mounted to a flexible support film in a sequence corresponding to their location in the uncut item, but with a spacing between adjacent strips so that the strips of the other item could be alternately arranged in the spacing. The laminate formed from the strips and support film is then mounted to a corrugated rigid support member with the peaks and valleys of the corrugated support member corresponding to the lines of contact of adjacent strips. The support member is mounted to a base member which facilitates a handling of the resultant composite for its ultimate use as a display unit.

The invention may be practiced with numerous variations involving most of the above noted basic steps. It is to be understood where different embodiments are described, features of one embodiment may be incorporated into other embodiments.

Figure 1:
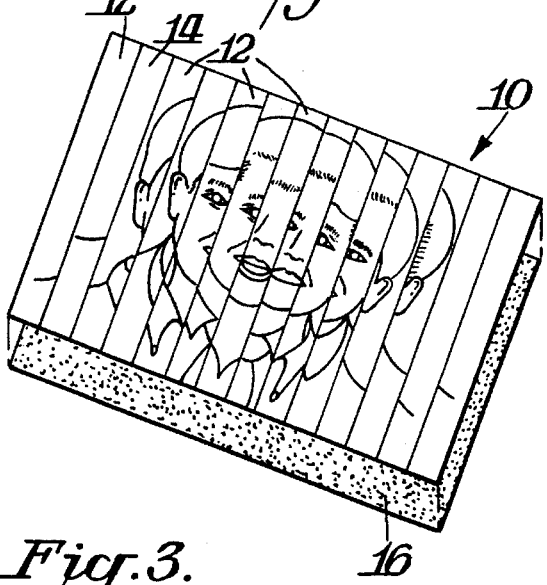
FIG. 1 is an exploded perspective view of a multi-item display unit in accordance with one practice of this invention during the step of assembly where the elongated strips are mounted to a backing film.
Figure 2:
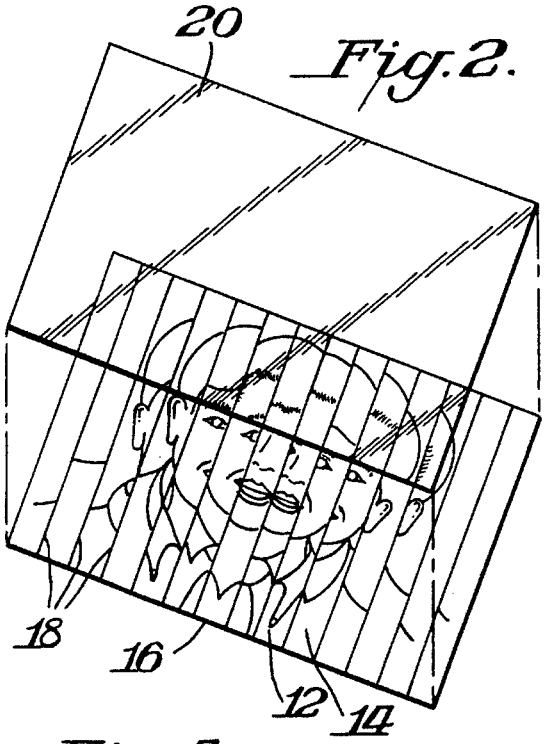
FIG. 2 is an exploded perspective view of the display unit shown in FIG. 1 Showing the mounting of a cover film over the elongated strips.

FIG. 1 illustrates the forming of a display unit 10 wherein the display items are two photographs. The elongated strips 12 of a first photograph are mounted to a flexible support film 16 spaced apart a distance so that the strips 14 of the second photograph could be placed in that spacing. As shown in FIG. 1, the strips are mounted on a suitable support member which is preferably a plastic film 16. This mounting is done while the support film 16 is a flat condition to facilitate the proper placement of the strips 12,14 juxtaposed and essentially contacting each other along contact lines 18. If desired, a laminate 21 could be created by mounting a further flexible transparent plastic film 20 over the strips 12,14 and backing film 16. FIG. 2 shows film 20 about to be disposed over the strips. Known methods of forming the plastic laminate 21 could be used such as heat sealing.

Figure 3:
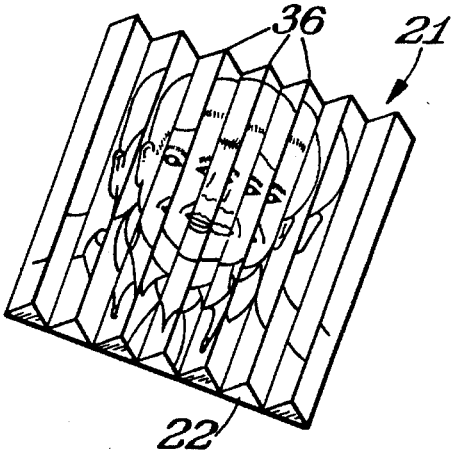
FIG. 3 is a perspective view illustrating the next stage of forming the display unit in accordance with this invention.
Figure 4:
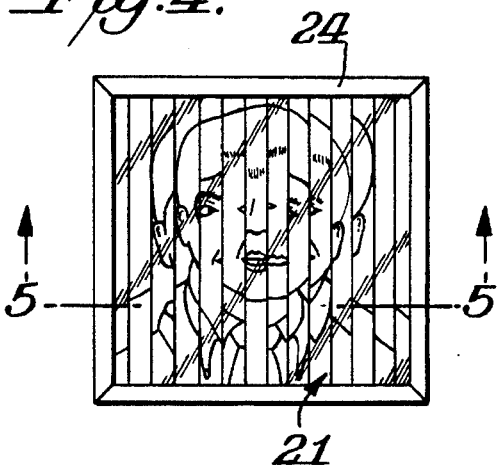
FIG. 4 is a top plan view of a display unit in accordance with this invention.

In the practice of the invention of FIGS. 1–5 the unsupported laminate is bent or folded at the contact lines 18 in an accordion type manner thereby forming a zig-zag frontal surface. As shown in FIG. 3 this zig zag frontal surface when viewed directly in front would result in the strips 12,14 of both photograph being visible. Film 20 which is transparent functions as a protective cover.

Figure 5:
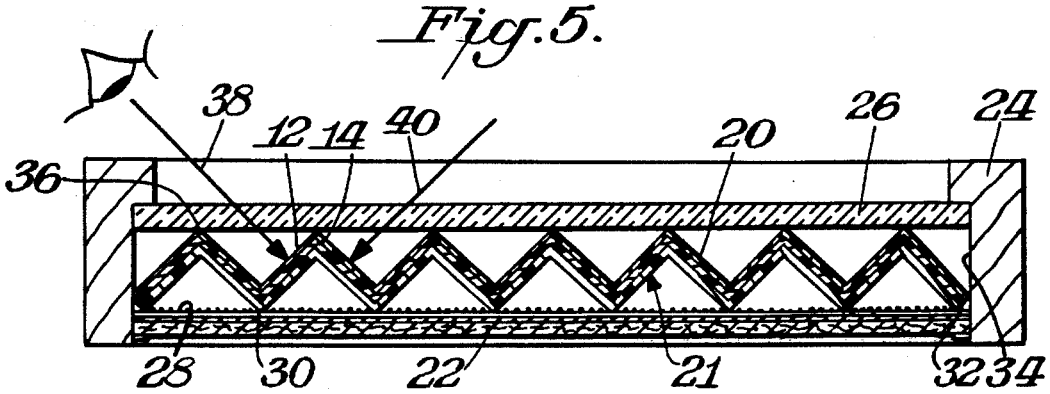
FIG. 5 is a cross-sectional view taken through the line 5—5 in FIG. 4.

As shown in FIG. 5 the folds are preferably at right angles to create a series of V-shaped peaks and valleys from the laminate 21. The laminate 21 in its accordion shape is mounted to a carrier or base member 22 which could be of any suitable material such as cardboard, plastic, foam, etc.

In the preferred practice of the invention using photographs, the laminate 21 and its carrier 22 are mounted in a frame 24 of the type conventionally used for the mounting of photographs. If desired, a transparent window 26 could be mounted in frame 24 in front of the viewing surface of the laminate 21. Window 26 could be of any suitable material, such as glass or plastic. The mounting of window 26 could also be done in manners conventionally done for the framing of photographs. The window 26 could replace film 20 or could be used in addition to film 20.

Although the laminate 21 of FIG. 5 is unsupported, the laminate 21 is held in its accordion type position by firmly securing the laminate 21 directly to carrier 22. Any suitable manner of this securement may be used. In the illustrated form a double faced tape 28 is applied to the exposed surface of carrier 22. The valleys or points 30 of the laminate 21 make spaced contact with the adhesive tape 28 to hold the laminate 21 in place. Further assurance of maintaining the accordion structure could also be achieved by having the ends 32 of the laminate 21 contact the side walls 34 of frame 24. Additionally, window 26 could be located so as to be juxtaposed or slightly contact the tips of peaks 36 as also illustrated in FIG. 5.

Figure 10:
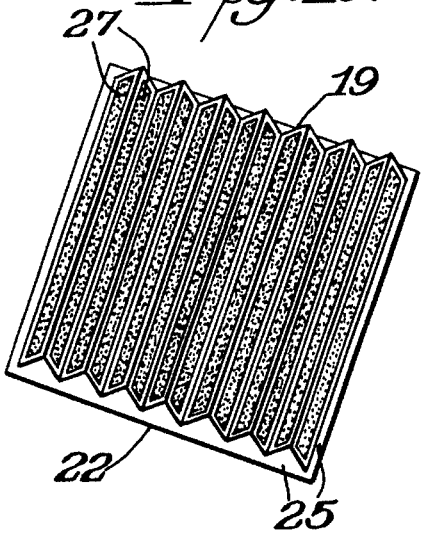
FIGS. 10 and 11 are perspective views similar to FIG. 9 showing subsequent steps in forming the display unit of FIG. 9.

If desired the laminate 21 may be secured to a support member, such as support member 19 of FIG. 10, to assure maintaining the corrugate shape.

Figure 6:
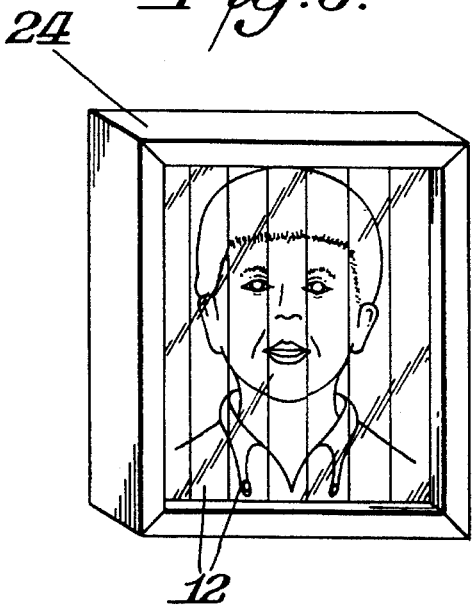
FIGS. 6–7 are perspective views showing the viewing image of the two photographs of the display unit of this invention in accordance with the viewing angle.
Figure 7:
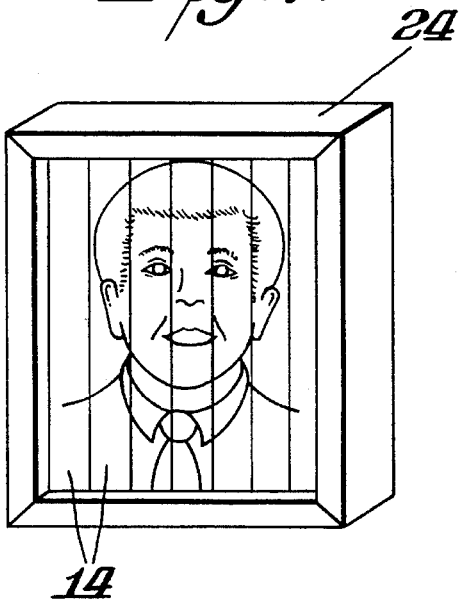

The purpose of the multi-item display unit 10 is to provide two display items, preferably of a common theme, each of which would be viewed depending upon the angle of view of the user. FIG. 5 illustrates a user having an angle of view 38 generally perpendicular to the alternate parallel elongated strips 12. At this angle of view only strips 12 would be viewed since strips 14 would be concealed. Thus, the viewer would see the first item, such as a photograph as shown in FIG. 6. When, however, an angle of view 40 is taken, which would be at right angles to strips 14, only the second item or photograph would be seen, such as shown in FIG. 7. Changing the view from one photograph to another would be accomplished by simply taking a viewing position 38 or 40 and then walking past the display unit 10 until the other viewing position is reached. This change in viewing positions would ordinarily occur by a simple walking across the room. During this walking the viewer would see a change from one picture to another right before the viewer's eyes. A selection of the photographs the viewer could, for example, result in seeing the same person as a child and then as an adult. Other themes could be used such as photographs of a family, pets, friends, weddings, graduations, business and before/after photographs.

The framed display unit 10 would be displayed in the conventional manners done with framed photographs. For example, frame 24 may be self-standing either by the dimensions and shape of the frame itself being sufficient to the support the frame or by carrier secured to the frame backing where the frame is placed at an angle as conventionally done with photographs. Alternatively, the frame could be mounted on a wall by a hook. It is to be understood that the above description is merely exemplary of how photographic frames are displayed. The invention is intended to include any known manners of such photographic display.

Figure 13:
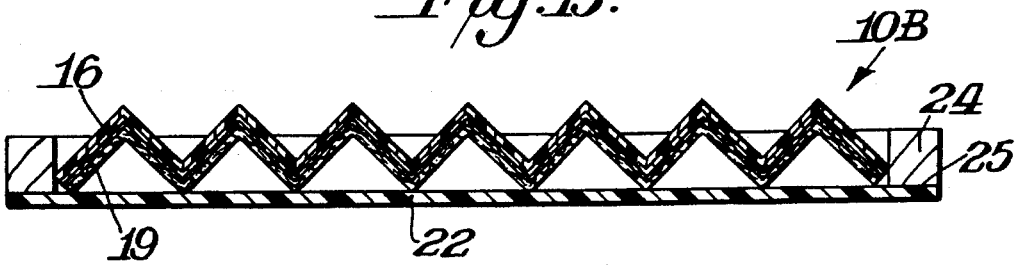
FIG. 13 is a cross-sectional view taken through FIG. 12 along the line 13—13.

It is to be understood that although FIG. 5 illustrates the frame to project outwardly beyond the display items, the invention may be practiced with a smaller dimension frame wherein the display items extend outwardly beyond the frame, as in FIG.13. This would be particularly suitable where the display items are covered by a transparent plastic film and the inclusion of a window would not be necessary.

Figure 8:
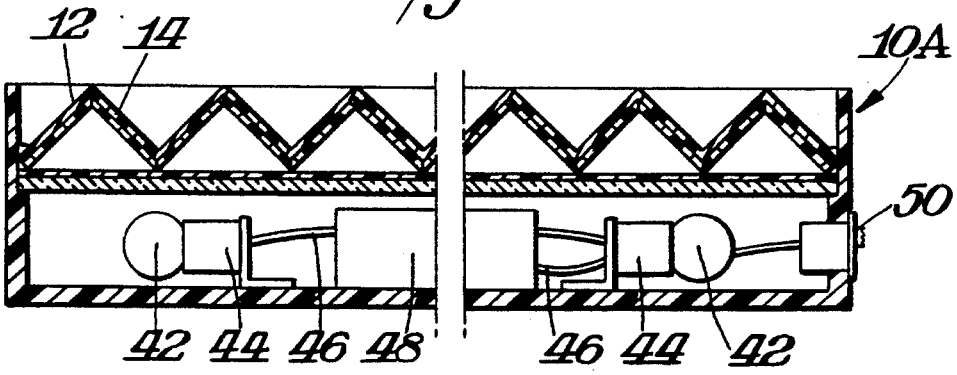
FIG. 8 is a cross-sectional view similar to FIG. 5 showing a modified form of the invention wherein the display unit is in the form of a tape box.

FIG. 8 illustrates a further variation of the invention wherein the display unit 10A is in the form of a light box which incorporates illumination devices, such as light bulbs 42,42 which would illuminate through the composite and thus provide light through and/or around the display items. In such practice of the invention transparent or translucent materials would be used including forming the display items of such transparent or translucent materials. Bulbs 42 can be mounted and powered in any suitable known manner. FIG. 8, for example, illustrates each bulb 42 to be mounted in a socket 44 connected by suitable electrical wiring 46 to a power box 48 which could be battery operated or operated from a wall outlet. Switch 50 would control the actuation of lights 42.

Figure 9:
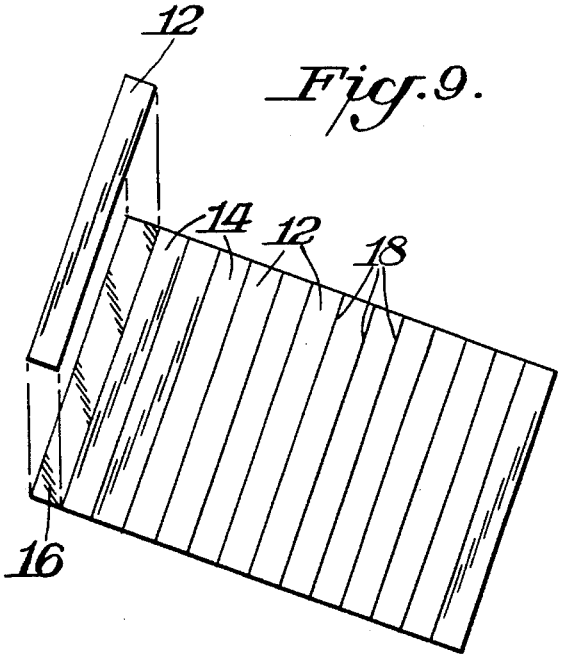
FIG. 9 is a perspective view showing a step in forming an alternative display unit in accordance with a preferred practice of this invention.

FIGS. 9–13 show a preferred practice of the invention wherein the display items are mounted with their front faces directly in contact with the support film. Thus, as shown in FIG. 9 the strips 12,14 are mounted to support film 16. In this practice of the invention support film 16 is transparent so that the front faces of the strips 12,14 are readily visible through the support film 16. Support film 16 thus serves the dual function of providing a mounting surface for the proper placement of the alternating strips 12,14 while in a flat condition and also later providing a protective shield for the strips when the unit is on display.

Where support film 16 is used in the manner of FIG. 9–13 by covering the top surface or viewing surface of the display items, any suitable means may be used for adhering the display items to the support film. For example, known clear plastic films can be used which have high adhering properties. Such items are used, for example, for wrapping foods and other items. Such films could be placed on a flat work surface. The strips 12,14 would then be sequentially placed and any excess film material could be cut while the strips and film are in a flat condition. If desired, other clear plastic materials could be used and the strips could be adhered by the placement of an adhesive substance along the outer edges of each strip to secure the strips to the film. In such practice the adhesive material would be transparent or could be provided in a thin line form so as to not be readily visible when the strips have been secured to the film to result in the formation of the laminate.

FIG. 10 illustrates other components for forming the display unit 10B. As shown therein a pre-formed assembly is made which comprises carrier 22 and corrugated support member 19 secured together in any manner such as by support 19 being glued to base 22. In the embodiment illustrated in FIG.10 carrier 22 extends peripherally beyond corrugated support member 19 on all four sides to provide a peripheral margin 25 as later discussed. The exposed surface of support member 19 had adhesive thereon such as from double face tape 27.

Figure 11:
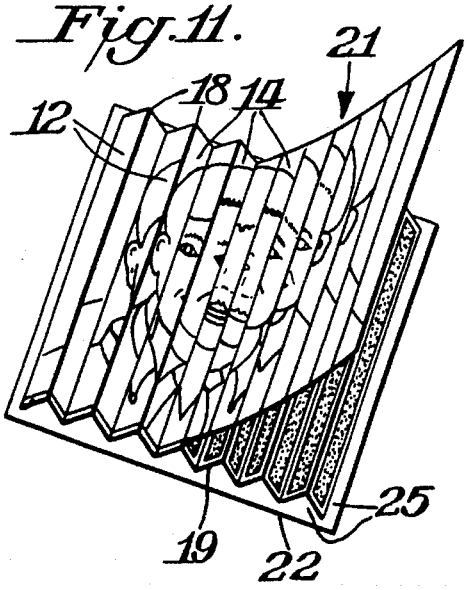
Figure 12:
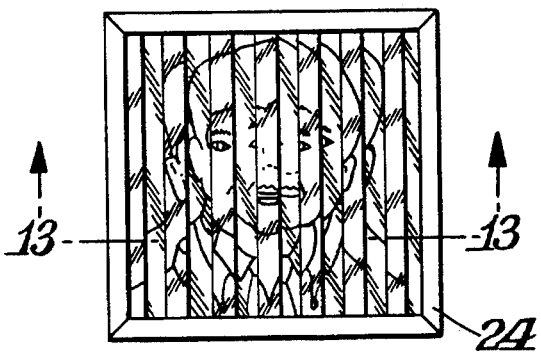
FIG. 12 is a top plan view of a completed display unit formed in accordance with the steps shown in FIGS. 9–11.

After a laminate has been formed by mounting strips 12,14 to support film 16, the laminate 21 is secured to the assembly of support member 19 and rigid support carrier 22. FIG. 11 shows this operation wherein the mounting takes place starting from one end of support member 19 by placing the laminate 21 with its end strip 12 fitting along an appropriately dimensioned side of support member 19. The laminate is then applied by folding the laminate along the contact lines 18 which coincide with the peaks and valleys of support member 19. The manner of mounting the laminate continues until the entire laminate 21 has been mounted to support member 19. The composite formed from laminate 21 and from assembly 19,22 is then mounted to a frame 24, such as shown in FIGS. 12–13. Frame 24 is secured along the peripheral sides 25 of carrier 22. As illustrated, the laminate 21 extends outwardly beyond the outer edge of frame 24.

Figure 14:
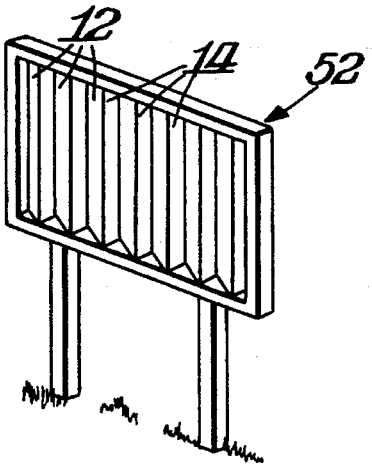
FIG. 14 shows a display unit mounted to a billboard.

It is to be understood that while the invention has been particularly described with respect to the mounting of photographs, other display items may be used. Such display items may range in size from only items which are a few inches long and few inches wide to march larger items including billboard size items. FIG. 14 illustrates a display unit on billboard 52. The display units may include, not only photographs or pictures, but other display items, particularly advertising items. Where, for example, a billboard is used, the viewing of one item might result in a message reminding riders of a vehicle that they are approaching a certain store or still within the confines of a certain city and then the second item would remind the viewer that the viewer has just passed the store or just left the city perhaps with a message welcoming the viewer to return.

As can be appreciated the ability to manipulate the strips while in a flat condition, permits the resulting laminate to then be more readily manipulated for being disposed in an accordion or corrugated type form. This is preferably accomplished by a preformed corrugated support member. By having the laminate placed in its corrugated or accordion condition, with or without a support member, and mounted to a carrier, the resultant assembly is in a condition for display.

What is claimed is:

1. A multi-item display unit comprising a first display item, said first display item being segmented into a plurality of uniform first elongated strips, a second display item, said second display item being segmented into a plurality of uniform second elongated strips of the same size and shape as said first elongated strips, a flexible support said first elongated strips being mounted to said support in a sequence corresponding to said first display item as a complete integral item, adjacent strips of said first elongated strips being spaced apart by a distance corresponding to the size and shape of individual strips of said second elongated strips, said second elongated strips being mounted to said support in a sequence corresponding to said second display item as a complete integral item, each of said second elongated strips being mounted between and juxtaposed to adjacent first elongated strips at lines of contact, each of said first strips being juxtaposed one of said second strips to provide a combination of alternating first and second adjacent strips mounted to said same support along a length of said support equal to the combined length of said adjacent first and second strips, said flexible support being made of a material capable of being in a flat planar condition for the mounting of said first and second strips thereon, each of said lines of contact comprising a fold line, a rigid carrier having a zig-zag upper surface with uniform V-shaped peaks and valleys, said support being folded in an accordion manner at said fold lines to create a zig-zag viewing surface with uniform V-shaped peaks and valleys of the same size and shape as said V-shaped peaks and valleys of said rigid carrier, each V-shape of said support having a first elongated strip and a second elongated strip, said fold lines permitting the degree of folding of said support film to conform to the angle of said V-shape of said carrier, all of said first elongated strips being parallel to each other, all of said second elongated strips being parallel to each other, said support comprising an integral single continuous one-piece base member for all of said first and said second strips, said base member comprising unitary strip mounting means for properly automatically positioning all of said strips mounted to said carrier along the complete exposed surface area of all of said strips without having to individually mount each strip to said carrier independently of other of said strips, said base member further comprising means to simultaneously hold all of said strips against said carrier and to prevent any of said strips from being independently detached from said carrier, said first display item being entirely and solely visible when viewed at a generally right angle to said first elongated strips, said second display item being entirely and solely visible when viewed at a generally right angle to said second elongated strips, and the viewing image changing as the viewing angle changes.

2. The unit of claim 1 including adhesive mounting means on said carrier.

3. The unit of claim 1 wherein said support is a transparent film, and said support being mounted to the viewing surface of said elongated strips.

4. The unit of claim 3 including a frame mounted around said support.

5. The unit of claim 4 wherein said display items are photographs.

6. The unit of claim 1 including a transparent protective mounted to said elongated strips on the viewing face of said elongated strips remote from said support film.

7. The unit of claim 1 wherein said support is mounted to the viewing face of said elongated strips.

8. The unit of claim 1 including a frame mounted around said display items.

9. The unit of claim 8 including a transparent window mounted to said frame and disposed in front of said display items.

10. The unit of claim 9 wherein said peaks are juxtaposed said window, and said display items having side edges which are juxtaposed the walls of said frame.

11. The unit of claim 8 wherein said support is mounted to the surface of said elongated strips remote from their viewing surface, and a transparent protective film mounted to said elongated strips at said viewing surface remote from said support.

12. The unit of claim 11 wherein said support extends outwardly beyond said frame.

13. The unit of claim 8 wherein said carrier has a peripheral edge outwardly of said display items, and said frame is mounted to said peripheral edge.

14. The unit of claim 13 wherein said display items are photographs.

15. The unit of claim 1 wherein said carrier is mounted to a light box, and illuminating means being in said light box.

16. The unit of claim 1 wherein said carrier is mounted to a billboard.

17. A method of forming a multi-item display unit comprising segmenting a first display into a plurality of uniform first elongated strips, segmenting a second display item into a plurality of uniform second elongated strips of the same size and shape as the first elongated strips, mounting the first elongated strips to a flexible support while the support is in a flat condition with the strips being in a sequence corresponding to the first display item before the first display item had been segmented, spacing the first elongated strips from each other during the mounting on the support, mounting the second elongated strips to the same support as the first strips with each second strip being in a spacing between pairs of first elongated strips and with the first elongated strips and second elongated strips being juxtaposed along parallel contact lines to create a laminate from the elongated strips and support film while in a flat condition, bending the laminate at the contact lines in an accordion manner from its flat condition to form a zig-zag viewing surface with peaks and valleys at the contact lines and with the bends being at about 90° so that all of the first elongated strips are parallel to each other and all the second elongated strips are parallel to each other, and mounting the zig-zag shaped laminate to a rigid carrier.

18. The method of claim 17 wherein the support is transparent, mounting the display items with their viewing surface against the support, providing an assembly of a corrugated support member on the carrier, mounting the laminate to the assembly by contacting one edge of the laminate against a corresponding edge of the corrugated support member and continuing to make contact between the laminate and support member while bending the laminate along the contact lines which correspond to the peaks and valleys of the support member.

19. The method of claim 18 wherein the display items are photographs which are segmented into the first strips and second strips.

* * * * *